US005546786A

United States Patent [19]

Fugel

[11] Patent Number: 5,546,786

[45] Date of Patent: Aug. 20, 1996

[54] SHAPING DEVICE

[75] Inventor: Martin Fugel, Friedrichshafen, Germany

[73] Assignee: MV Marketing und Vertriebs - GmbH & Co. KG., Germany

[21] Appl. No.: 297,970

[22] Filed: Aug. 30, 1994

[30] Foreign Application Priority Data

Aug. 30, 1993 [DE] Germany ..... 9312980 U

[51] Int. Cl.[6] ..... B21D 1/12

[52] U.S. Cl. ..... 72/457; 72/705

[58] Field of Search ..... 72/457, 705

[56] References Cited

U.S. PATENT DOCUMENTS 3,801,772 4/1974 Curcio et al. ..... 72/705

4,044,590 8/1977 Strahm ..... 72/705

5,016,464 5/1991 Tomelleri ..... 72/705

FOREIGN PATENT DOCUMENTS 2550971 3/1985 France ..... 72/705

1162315 2/1964 Germany ..... 72/705

*Primary Examiner*—Lowell A. Larson

*Attorney, Agent, or Firm*—Gifford, Krass, Groh, Sprinkle, Patmore, Anderson & Citkowski, P.C.

[57] ABSTRACT

A device for shaping thin-wall components such as for repairing damage to a motor body comprises a holding member which can be welded to the component, and a pulling device for applying a pulling force to the holding member. The pulling device is motor-actuated and, after the holding member has been welded to the component, a part of the latter which is to be shaped can be moved into a predeterminable limit position by motor actuation by the pulling device.

19 Claims, 8 Drawing Sheets

FIG. 8a
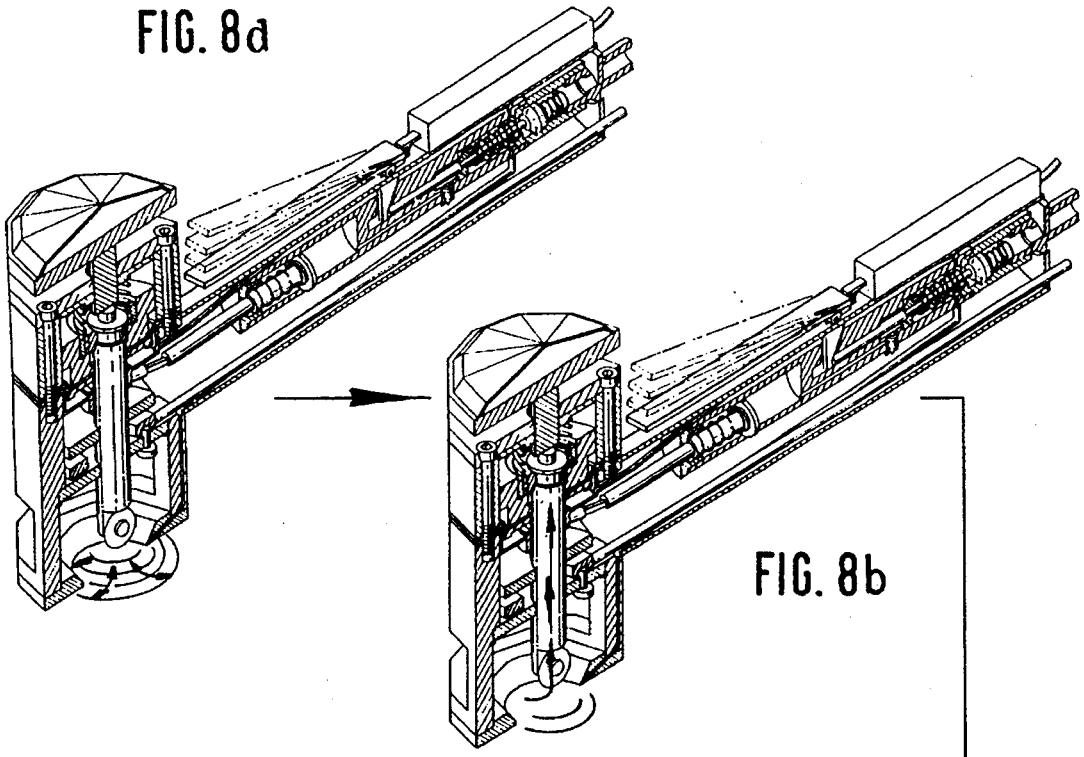
FIG. 8b
FIG. 8c
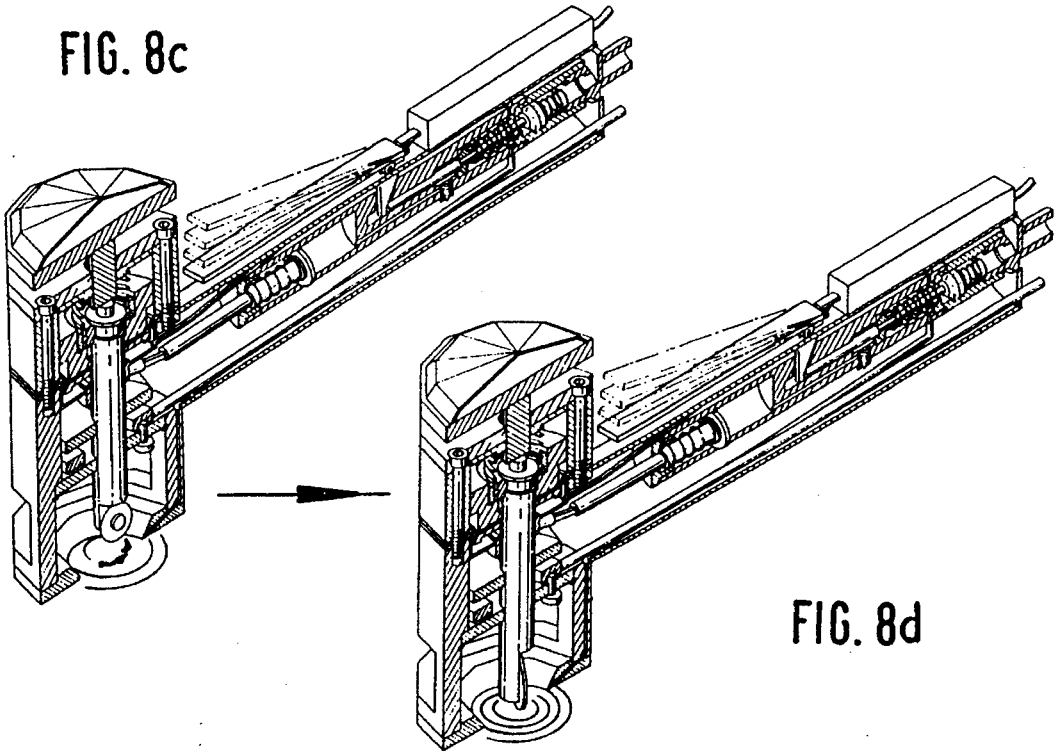
FIG. 8d

SHAPING DEVICE

BACKGROUND OF THE INVENTION

The invention generally concerns a device for deforming or shaping thin-wall components and more particularly but not exclusively a device for repairing damage to motor body parts.

A conventional procedure for repairing motor bodywork damage as occurs for example when the vehicle is struck by hail, when it is hit by a heavy stone, when the bodywork suffers from scratches of considerable depth or when it has elongate dents, involves exposing the metal of the bodywork panel, welding a ring or other pulling member on to the exposed metal and manually shaping the damaged part back into its correct shape by means of a hammer device or a pulling device. That operation is repeated in a stepwise manner until the damage in the panel area is approximately rectified and is accessible for further treatment by means of body filler material and/or painting. All that however is a time-consuming process.

EP-A-0 544 191 discloses a device for deforming or shaping thin-wall components, comprising a holding member which can be welded to the component, and a pulling device for applying a pulling force to the holding member. In the above-described procedure, for the purposes of avoiding structural fatigue of the component to be shaped, that publication teaches that deformation of the component such as a motor body part to restore it to its proper shape, after the holding member has been welded thereto, is to be effected slowly and manually, with visual inspection and control. In that procedure the metal is deformed in the cold condition and, after it has been deformed, frequently retains stresses which under some circumstances result in unstable or wavy bodywork regions which are still under stress, so that frequently such areas have to be subjected to a time-consuming operation for further treatment thereof. In the event of severe hail damage however, damage occurs over a large area, and such damage can no longer be economically repaired by the conventional procedure, having regard to the working times required for that purpose. In addition, the device disclosed in EP-A-0 544 191 is of an extremely bulky and voluminous structure with a plurality of handles which make it impossible to operate on parts of the vehicle body which are inaccessible or difficult to reach, such as for example behind door cladding panels or in the interior of a motor fender.

SUMMARY OF THE INVENTION

An object of the present invention is to provide a device for deforming thin-wall components such as motor body parts, which is easier to operate and which affords improved working results.

Another object of the present invention is to provide a device for deforming thin-gauge components, which can be employed in a more universal manner and thus on a wide range of different kinds of components.

Still another object of the present invention is to provide a device for repairing damage to motor body parts which affords high-quality results in an economic fashion while being simple to operate.

In accordance with the present invention the foregoing and other objects are attained by a device for deforming thin-wall components, for example for repairing damage to motor body parts, comprising a holding member which can be welded to the component to be deformed, and a pulling means for applying a pulling force to the holding member. The pulling means can be actuated by motor means and, after the holding member has been welded to the component to be deformed, a part of said component can be moved into a predetermined limit position by motor actuation of the pulling means.

In a preferred feature of the invention the device may have a means for supplying coolant, for example air, to the heated part of the component which has been restored to its intended shape. By virtue of the defined cooling effect which is produced in that way, as a kind of quenching action, the improvement in strength which that involves can have a positive influence in regard to the stability of the area which has been shaped by use of the device according to the invention. Usually, the mechanical stresses which are produced when using the prior-art procedures and which under some circumstances may require a subsequent heat treatment to deal with them, occur only to a minor degree or not at all when using the device according to the invention.

If the motor-actuated pulling device is operated pneumatically, the cooling air can be supplied in a simple fashion, employing the compressed air source which is used for operation of the device. The work is further substantially speeded up thereby, as directly after the operation of pulling the component into shape, the entire area thereof is cooled down and it is then possible to proceed with further treatment immediately beside the location which has been subjected to the operation of the device according to the invention. That makes the device according to the invention even more suitable for repairing even damage which covers a large area.

Damage to the rear of the component or motor body part to be repaired is greatly reduced; inevitable paint damage on the rear of the area to be treated is less and the likelihood of damaging for example adjacent plastic parts, roof linings which are stuck in position or adjoining fuel-carrying parts is greatly reduced by virtue of the immediate cooling effect.

A motor-actuated device for releasing the welded holding member further speeds up the working operation, without additionally burdening the operator.

In accordance with a further preferred feature, only one single, manually actuable operating element is provided for the operating procedures of welding the holding member in place, pulling it, effecting cooling, twisting the member off and/or return to the initial position. With such a device configuration, the substantially improved operability of the device means that, after just a brief period of time to become acquainted with the way in which the device works, it is possible to operate therewith quickly and as a matter of natural reflexes on the part of the operator.

In an advantageous feature in that respect the manually actuable operating element of the device has an operating lever or trigger for the successive actuation positions which are associated with the individual operating procedures to be carried out. By virtue of those actuating positions which are associated with the individual operating procedures, the operator can easily retain full manual control over all operating procedures.

In another preferred feature of the invention the device has a pneumatic control group or unit which is disposed in or on a grip or handle portion of the device and which produces the pneumatic control procedures by virtue of the axial position of a single pneumatic control member. That affords a mechanically reliable and compact structure which affords preliminary assistance for automation. Then, to provide for automation, all that is required is a further operational group which provides in automated fashion for actuation of the single pneumatic control member and optionally an electrical supply unit for the welding operation.

If, in accordance with a further feature of the invention, the pulling device reaches a defined limit position with an adjustable depth stop, holding members of different sizes can be used, by means of suitable adjustment. As, in that way, the holding members employed can be essentially any kind of weld-on member, it is possible to use either holding members which are specifically adapted to the damage to be repaired, or the usual metal support disks or plates, which reduces the amount of cost involved. By using the depth stop, it is possible to set the zero level of the original bodywork shape or it is possible to set a defined amount of over-stretching of the metal of the bodywork shape. When the damaged location is of a rounded or radiused configuration, it is possible to take suitable account of the longer distance corresponding to the rounded configuration, and thus the greater pulling depth.

If, in a preferred feature of the invention, the device has a means for the automatic supply of cooling air when the end or limit position of the pulling means is reached, it is then possible to omit an actuating position of the hand lever or trigger, so that operation of the device is further simplified. If that means or a further means also automatically provides for release of the holding member in a subsequent phase in operation, only single actuation of the operating member is required for the complete operational procedure involved in restoring the shape of the motor body part after the holding member has been welded thereto.

Alternatively, a defined, pre-programmable pulling and cooling procedure which can be controlled in respect of time and which always ensures optimum operation can be achieved with an electrical and/or pneumatic control device which provides for automated performance of the operations of welding the holding member in place, pulling it, effecting cooling, twisting it off, and/or return to the starting position.

If the operation of pulling the holding member after it has been welded in position is effected in a jerk-free manner, preferably by means of a throttle disposed in the pneumatic feed line leading to the pneumatically actuated pulling means, that avoids force peaks by virtue of gently starting the pulling operation, and accidental detachment of the holding member from the component to be shaped is thus prevented. The initially gentle pulling effect takes account of the very hot state of the material to be shaped, and prevents unintentional over-stretching of the material in the region of the weld location.

In accordance with another feature of the invention, the pulling means may be provided with one or more foot portions which can be fitted thereto and which can be of a selectable contact shape for bearing against the component to be shaped by the device according to the invention, in the pulling operation. In that way, the device can be suitably adapted to different forms of damage, such as for example damage of round or elongate or other configuration.

In a system for operating on thin-wall components, for example for repairing damage to motor bodies, it is possible to provide for a definedly adjustable application of heat with a predeterminable characteristic in respect of time, with the device according to the invention and a supply unit for the operation of electrically welding the holding member to the component to be worked on. In that way the rise in temperature and the rate of temperature variation in respect of time can be adjusted to optimum values, in regard to the thickness of the sheet metal involved, and/or the size of the damage.

Although the device according to the invention is already fully operational with standard connections for the electrical welding operation and a standard connection for a pneumatic supply apparatus, the supply apparatus, in the above-indicated system, may alternatively also include electrical or electronic control devices for the individual operating procedures to be performed.

Further objects, features and advantages of the invention will be apparent from the following description of preferred embodiments.

BRIEF DESCRIPTION OF THE DRAWINGS

FIGS 8*a* through 8*d* show perspective views of the operating procedures of FIGS. 1 through 7 in their sequence.

DESCRIPTION OF PREFERRED EMBODIMENTS

Figure 1:
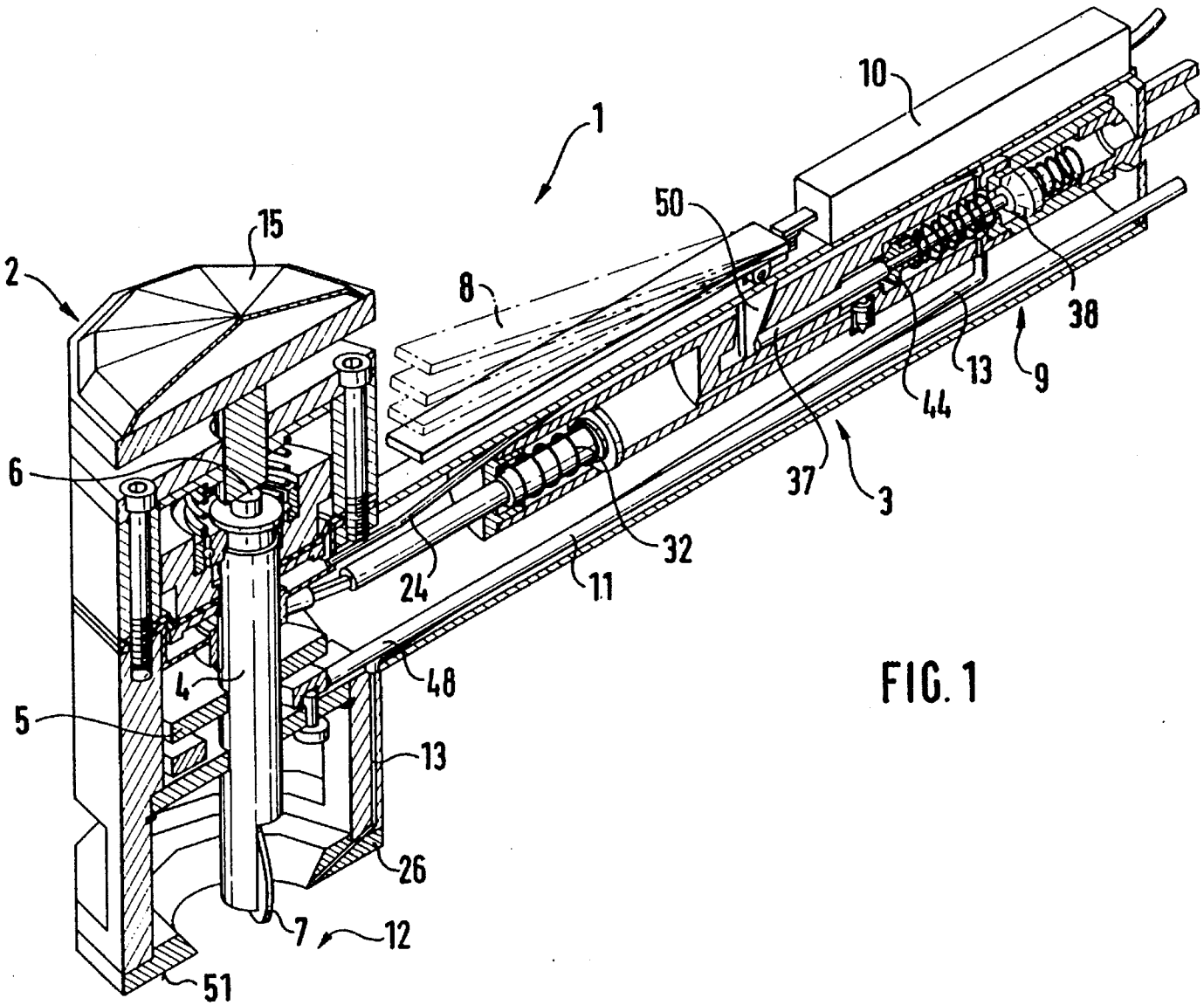
FIG. 1 is a perspective view from the front of a device according to the invention shown in cross-section in the longitudinal direction thereof.

It will first be noted that, just for the sake of clarity of the drawings, none of the Figures is shown on the true scale. All the views relate to the essential operational groups of preferred embodiments, without illustrating additional casing enclosures or further handling or holding grips or handles as such components are conventional and therefore do not need to be described in full detail herein.

The device according to the invention for deforming or shaping thin-wall components such as for repairing damage to motor body parts, as generally indicated by reference numeral 1, includes a head portion 2 and a grip or handle portion 3 which is secured thereto perpendicularly at approximately the center thereof.

Arranged within the head portion 2 the device 1 essentially includes a pulling device 4 which can be actuated by motor means, a device 5 which can be actuated by motor means for releasing a holding member 7, and a stop 6 for the pulling device 4. Arranged in or on the handle portion 3 the device 1 essentially includes a manually actuable operating element 8, a pneumatic control group or unit 9, a device 14 for the automatic feed of coolant and/or for automatically effecting detachment of the holding member 7, and an electrical switch device 10. Disposed in the handle portion 3 and in the head portion 2 are an electrical feed device 11 in the form of a feed line 48 for the operation of electrically welding the holding member 7 to a component to be shaped or deformed, as indicated by the arrow 12 in FIG. 1 and shown in further detail for example in FIG. 2.

Beneath the head portion 2 the device 1 carries a foot portion 26 which is held in position by friction, screwed to the head portion, fixed by the retaining force of a retaining element such as a latch and/or held in place by a bayonet fixing. The foot portion 26 is thus preferably interchangeably carried on the head portion 2. The contact surface 51 of the foot portion 26, with which the device 1 bears against the component 12, has, depending on the situation of use, an opening of round, elongate, oval or polygonal shape, and can be adapted in optimum fashion to the damage to be repaired, by virtue of suitably interchanging the foot portion 26. The device may have a plurality of foot portions 26.

The head portion 2 which is overall substantially cylindrical is provided at its upper end with an adjusting member such as a wheel 15 for the depth stop 6, the adjusting wheel 15 being of approximately the same diameter as the head portion 2. The adjusting wheel 15 is connected to a screwthreaded pin or an adjusting screw 16 having a fine screwthread which is rotatable in a screwthread 17 in the head portion 2 and is thus axially adjustably held therein, as can be clearly seen from FIG. 2.

Figure 2:
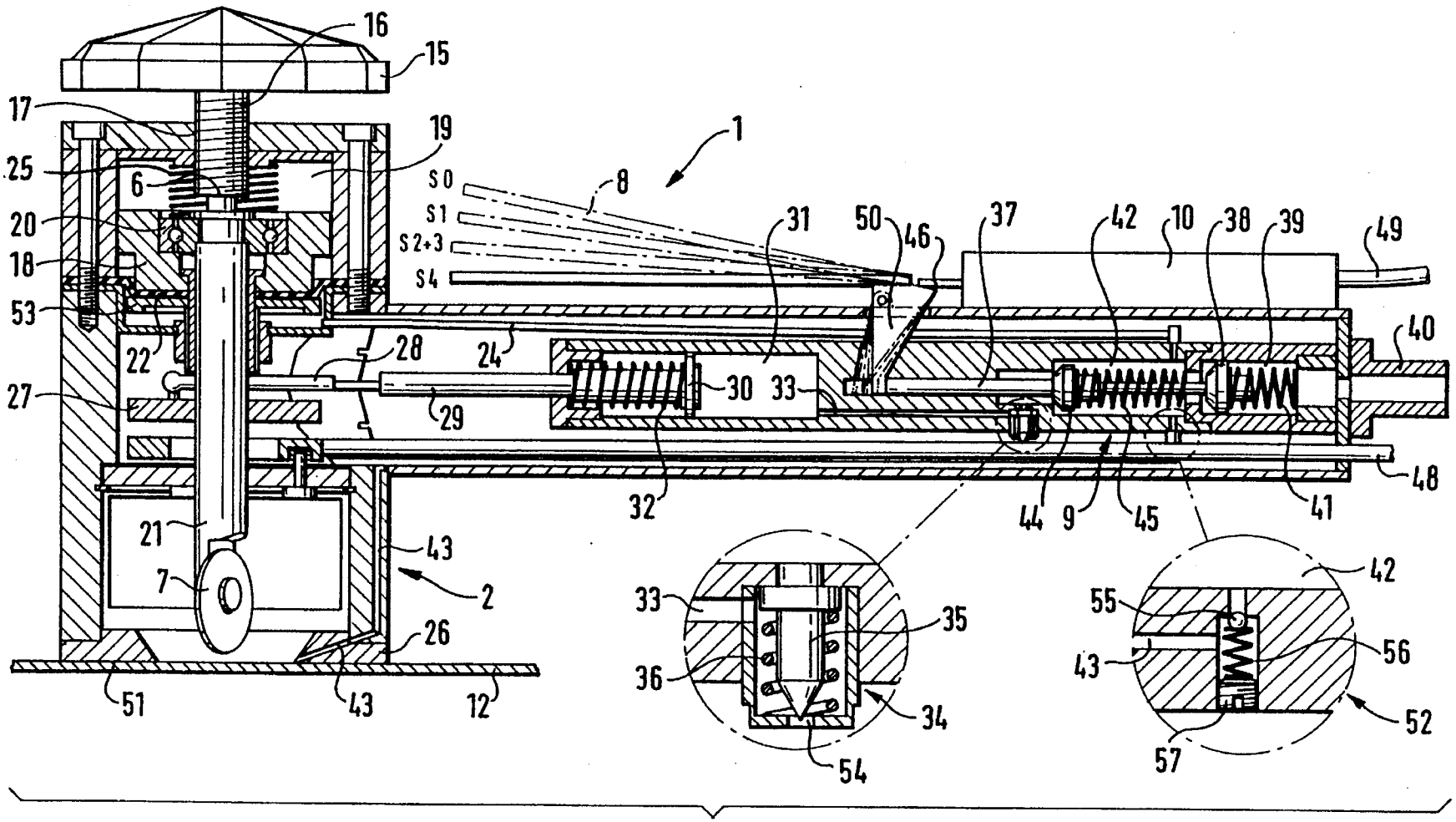
FIG. 2 shows a modified form of the device illustrated in FIG. 1 in a view from the side on to the cross-section in the longitudinal direction.

Looking therefore also at FIG. 2, a piston 18 is axially displaceably carried in a cylinder chamber 19. Arranged in the middle region of the piston 18 is a rotatable bearing 20, the inner bearing shell of which carries a pull rod 21 in such a way that the latter is held rotatably but not axially displaceably relative to the piston 18. The holding member 7 is carried at the lower end of the pull rod 21, preferably by way of a screw arrangement.

Figure 6:
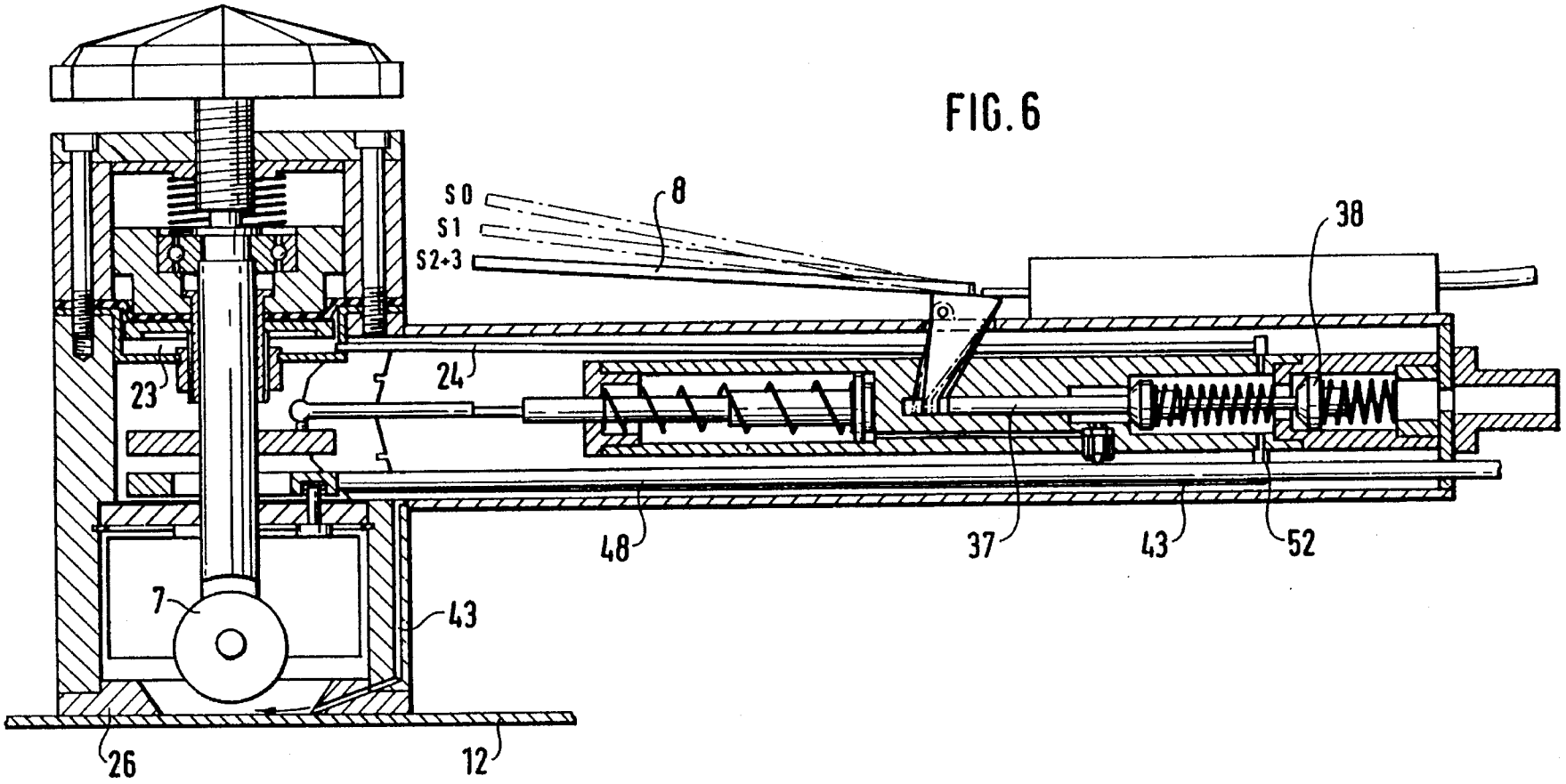
FIG. 6 shows the supply of cooling air for cooling the shaped component.

Beneath the piston 18 a diaphragm 22 is connected on its outside to the housing of the head portion 2 and at its center to the piston 18 in such a way that it closes off the cylindrical space indicated at 23 in FIG. 6 sealingly and movably in an upward direction. Below the diaphragm 22 a plate-like support disk 53 is mounted to the pull rod 21. The cylindrical space 23 surrounds the pull rod 21 and is fluid-tight with respect thereto.

A pneumatic feed line shown at 24 in FIG. 1 communicates the cylindrical space 23 with the pneumatic control group or unit 9 in such a way that, when a fluid is supplied through the feed line 24, the piston 18 is moved into the upper axial limit position, acting as a motor means, against the force of a compression spring 25 which bears against it at its end face. In that situation the upper end of the pull rod 21 bears against the depth stop 6. The fluid under pressure can be discharged to the surrounding area from the space 23 through the feed line 24 either after opening of the valve 52 which will be described in greater detail hereinafter or, if the device does not have the valve 52, the fluid can be discharged continuously in a smaller amount along the line 43, and in that case the piston 18 and the pull rod 21 secured thereto move into the lower axial limit position, being the original starting position.

That lower axial limit position is so selected that the pull rod 21 with the holding member 7 fixed thereto projects far forwardly beyond the foot portion 26 of the device 1. The distance by which the pull rod 21 with holding member 7 projects in that way can be influenced by suitably selecting the diameter or the size of the holding member 7, but it is preferably at least about 3 mm, 5 mm, 8 mm or more, so that at any event the usual depth of damage can be reliably dealt with, by the device according to the invention.

Fixed to the rotatably disposed pull rod 21 in the middle region thereof is a plate 27 which has an eccentric rotatable and tiltable mounting member for mounting a connecting rod 28. The connecting rod 28 at its front end is rotatably and tiltably eccentrically connected to the plate 27 while at its rear end it is rotatably and tiltably connected to a push-pull rod 29 of the pneumatic piston 30. The pneumatic piston 30 is held in its right-hand axial position (as viewing FIG. 2) in the pneumatic cylinder 31 by the force of a compression spring as indicated at 32, when a fluid under pressure is not supplied to the pneumatic cylinder 31 by way of a feed line 33. The compression spring 32 which is only diagrammatically illustrated is preferably a fatigue-free coil spring, the force of which is such that, in spite of mechanical friction, the piston 30 is always moved into its right-hand axial limit position when ambient pressure obtains in the cylinder 31, whereas the plate 27 and the pull rod 21 are turned when fluid under pressure is supplied by way of the feed line 33. That arrangement ensures that, at normal operating pressures of between 4 and 10 bars, preferably 6 and 10 bars, the holding member 7 is always certain to be sheared off the component 12 after the operation of shaping same, by virtue of the transmission effect of the connecting rod 28 which eccentrically acts on the plate 27, and by virtue of the diameter of the piston 30 and the cylinder 31. That then gives the condition shown in FIGS. 1, 2 and 7, in which the component 12 has been appropriately shaped by operation of the device and the holding member 7 has then been sheared off the component by a twisting movement.

For automatically producing the shearing action, the feed line 33 is connected to a multi-functional valve 34 which is additionally shown on an enlarged scale in FIG. 2. The valve 34 also acts as a pressure relief valve. The valve 34 connects the feed line 33 to the pneumatic control group 9 and, as described in greater detail hereinafter, can temporarily communicate at its input with the feed line 24 to the cylindrical space 23. That forms the device 5 for automatically releasing the holding member 7. When the depth stop 6 is reached, a rise in pressure occurs in the cylindrical space 23 and in the region of the feed line 24 and in the chamber 42. When the operating element 8 is in the position indicated at S4 in FIG. 2, that rise in pressure results in opening of the multi-functional valve 34 when the conical sealing element 44 is pushed back towards the right in FIG. 2 and the chamber 42 is thereby communicated with the valve 34.

In that situation the valve member 35 of the valve 34 moves back out of its sealing contact against the upper stop shown in FIG. 2, against the force applied by the compression spring 36, it opens the feed line 33, and with its lower conical end it fluid-tightly closes the opening 54. As a result, the rise in pressure which then occurs in the cylinder 31 results in the above-described turning movement of the plate 27 and therewith the pull rod 21. When the operating element 8 is pivoted back into the position indicated at S2+3 in FIG. 2, the sealing element 44 fluid-tightly closes off the chamber 42 relative to the valve 34. Then, under the force of the compression spring 36, the valve member 35 moves back into a position of bearing against its upper stop in the valve 34, in which case the lower opening 54 is opened and the cylinder 31 is then vented therethrough. In that case, under the effect of the compression spring 32, the piston 30 and thus the device 5 for releasing the holding member assume their original starting position.

Referring to both FIGS. 1 and 2, a pneumatic control member 37 of rod or bar configuration is axially displaceably mounted within the pneumatic control group 9. The left-hand end of the control member 37 is engaged by a shorter lever arm 50 of the pivotable manual operating element 8 which has the four actuating positions indicated by S0 through S4 in for example FIG. 2. At the right-hand rearward end of the control member 37, a conical sealing element 38 is sealingly connected thereto. The end of the sealing element 38, which is at the right in for example FIG. 2, is engaged by a diagrammatically illustrated compression spring 41 which is disposed in the chamber 39.

According to the position of the pneumatic control member 37 and thus the sealing element 38, in the actuating positions S2+3 and S4, air supplied by the pneumatic feed line 40 can be passed from the chamber 39 into the chamber 42. The pneumatic feed line 40 is suitably connected to any appropriate compressed air source during operation of the device.

When the operating element 8 is pressed into the position S2+3, the conical sealing element 38 is displaced rearwardly in the chamber 39 so that the air which is flowing into the chamber 42 acts by way of the feed line 24, in the manner already described above, to cause the return movement of the pull rod 21 and thereafter, in position S4, it causes the holding member 7 to be twisted off the component 12.

In that situation, in a first embodiment according to the invention cooling air flows out of the chamber 42 along the feed line 43 which forms a part of the device 13 for supplying coolant. The feed line 43 extends from the chamber 42 to the foot portion 26 and through the foot portion 26, from which the cooling air is guided on to the component 12 to be treated, which has been heated by the welding operation.

Figure 3:
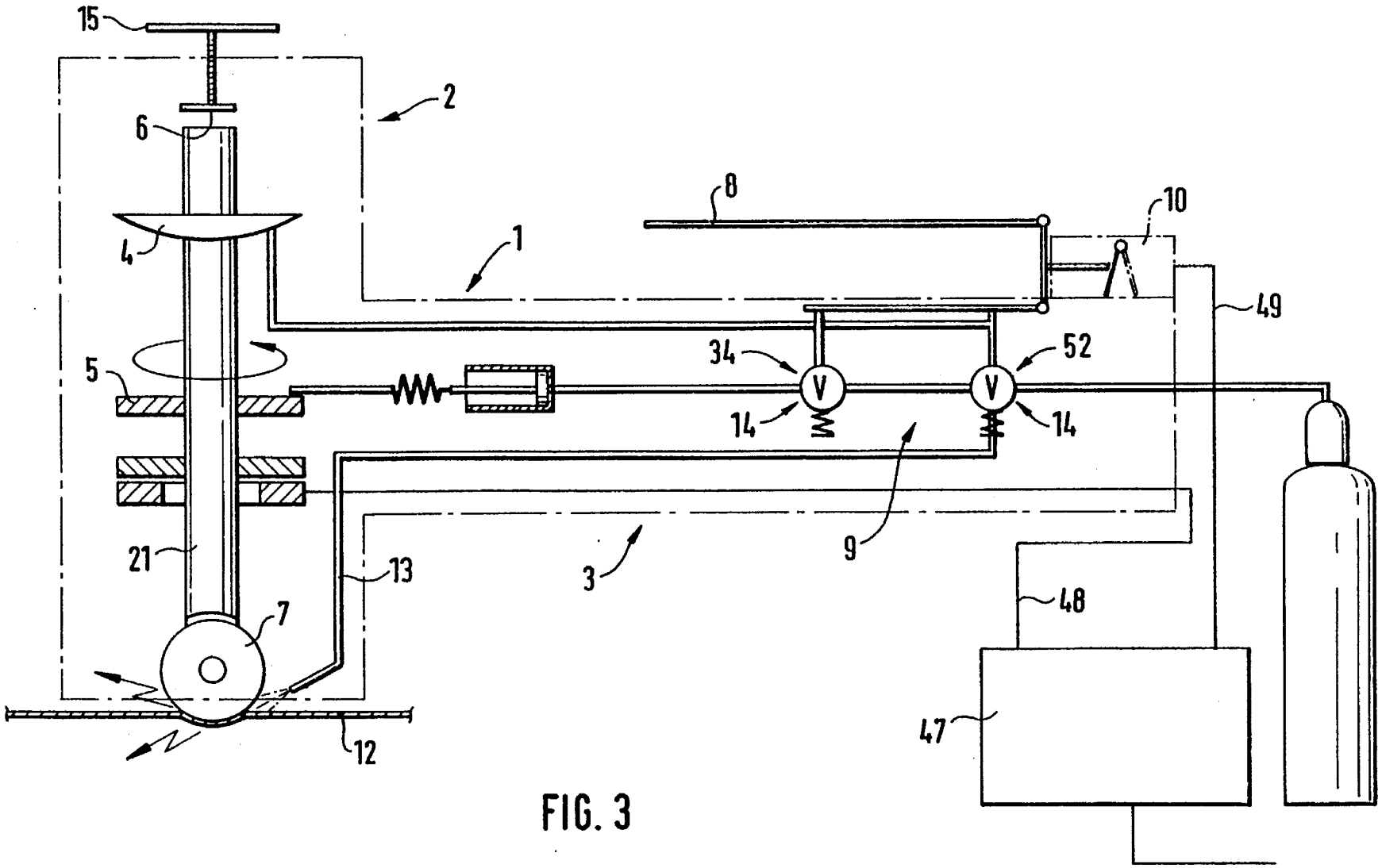
FIG. 3 is a diagrammatic view of basic operational groups of the device shown in FIGS. 1 and 2.

In a further designed configuration according to the invention, disposed in the feed line 43 is a further pressure relief valve 52 which is shown on an enlarged scale in FIG. 2 and which is illustrated only in diagrammatic form in FIG. 3. The pressure relief valve 52 provides for a feed of cooling air only after the pull rod 21 reaches the upper limit position and before the increased pressure for detachment of the holding member 7 is attained. The pressure relief valve 52 includes a ball 55 which is held in its upper position sealingly against an opening leading to the chamber 42, by a compression spring 56. The opening pressure of the pressure relief valve 52 can be finely adjusted by means of an adjusting screw 57 to that the feed 43 communicates with the chamber 42 only from the desired increased pressure which can be for example 6 bars.

In the cylindrical chamber 42, a conical sealing element 44 is held in a condition of sealing abutment against the left-hand end of the chamber 42, under the force of a diagrammatically illustrated compression spring 45. The sealing element 44 is longitudinally displaceably fixed to the right-hand, radially reduced part of the pneumatic control member 37, in such a way that, when the operating element 8 is pressed into the position S2+3, the conical sealing element 38 admittedly no longer bears against the end of the chamber 39, but the sealing element 44 has still not been moved into the open position against the force of the compression spring 45. When the operating element 8 is further pressed into the position S4 however the sealing element 44 is engaged at its end face by the radially enlarged portion of the control member 37 which thus forms a step that bears against the end face of the sealing element 44, and the sealing element 44 is thus moved towards the right in FIG. 2 so that access to the multi-function valve 34 is opened.

The radially sealed mounting of the control member 37 in the housing of the pneumatic control group 9 prevents unintentional discharge of fluid and the above-described rise in pressure in the upper limit position of the pull rod 21 can be used for twisting off the holding member 7.

The various successive actuating positions S0 through S4 which are associated with the individual operating procedures can be easily detected by the operator, by touch, by virtue of a respective increase in pressure which takes place in a stepwise fashion.

In position S0, the operating element 8 is only subjected to the force of the switch arm 46 of the electrical switch device 10. With the supply device 47 shown in FIG. 3, for the electrical welding operation, actuation of the operating element in position S0 triggers off a condition of readiness for the supply of welding current.

Figure 4:
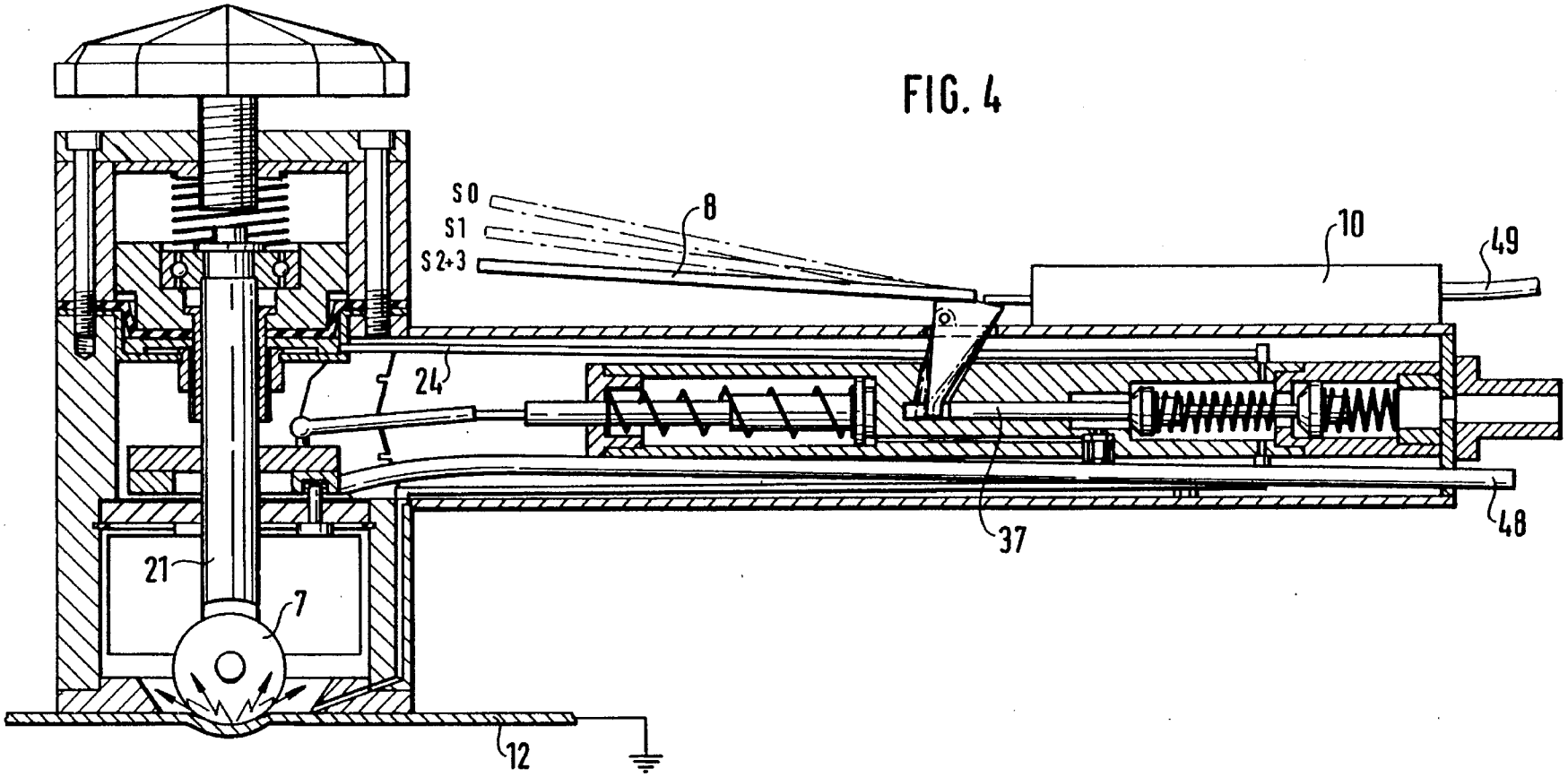
FIG. 4 shows the operation of welding the holding member in place, when using a device according to the invention as shown in cross-section in the longitudinal direction.

In position S1 of the operating element 8, the pull rod 21 assumes the forwardly displaced position shown in FIG. 4. When the holding member 7 is in contact with the component 12 which is connected to ground of the welding potential, a welding current flows by way of the electrical feed line 48 which is conductingly connected to the pull rod 21, and the welding current causes the holding member 7 to be welded to the component 7.

To prevent voltage-carrying members from being accessible from the exterior, the pull rod 21 is carried in electrically insulated relationship within the head portion 2, or the entire device 1 is surrounded by an insulating casing. The supply of welding current from the flexible feed line 48 to the pull rod 21 can be through an elastic cable guide or, as described above, through a fixedly mounted rotatable plate member.

In that respect, the supply device 47 may be any commercially available device which is suitable for electric welding such as for example a welding transformer with suitable electrical control.

In a further configuration according to the invention however the supply device 47 includes an adjustable electrical control device which in the component 12 results in a definedly adjustable input of heat, with a predeterminable performance in respect of time which produces a defined increase in temperature during and/or after the operation of welding the holding member 7 to the component 12.

Figure 5:
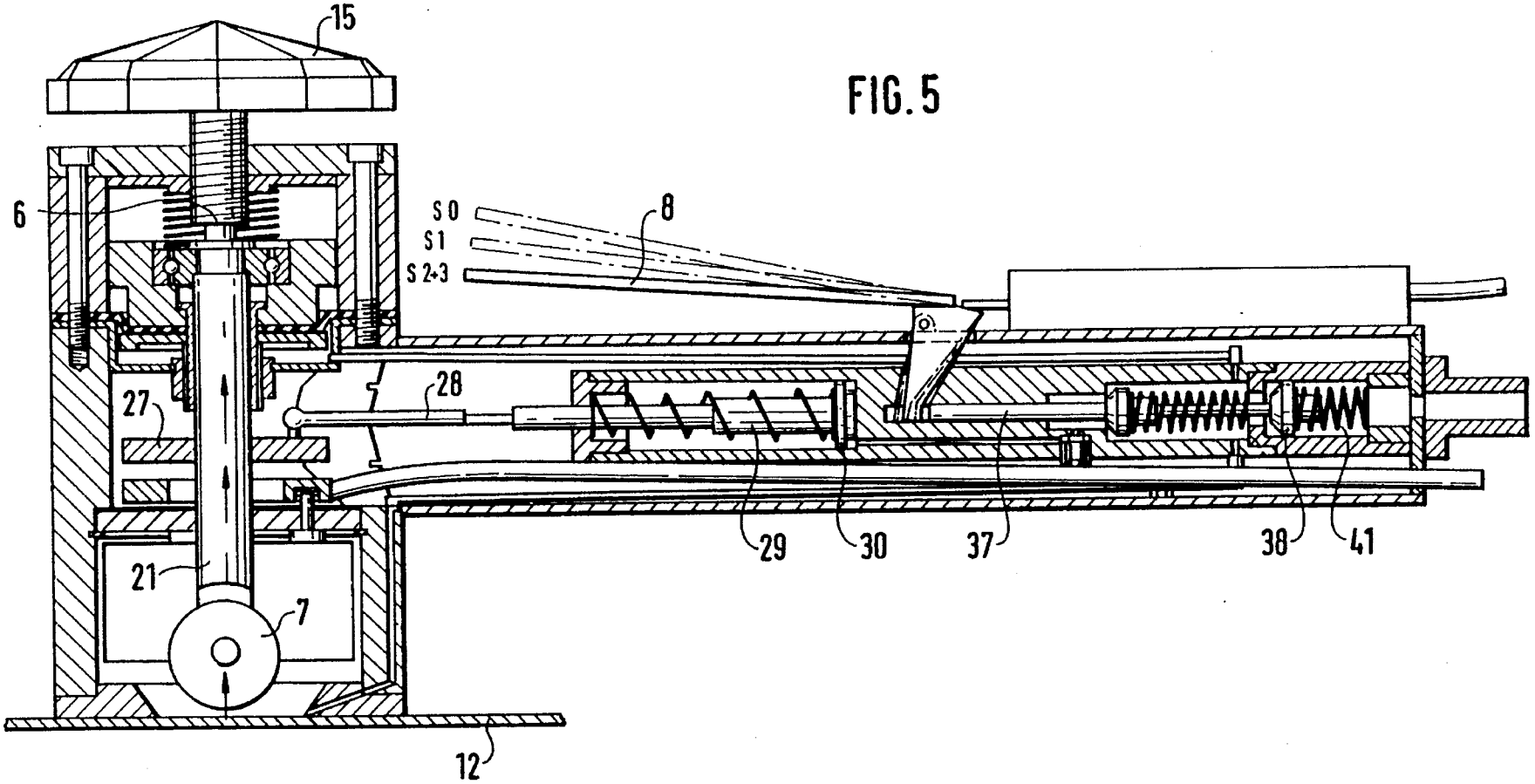
FIG. 5 shows the operation of pulling on the holding member, and the accompanying deformation of the component or motor body part which is being shaped.

After the welding operation when the operating element 8 is in position S1 and when the operating element 8 is further depressed to put it into position S2+3, then, as shown in FIG. 5, the pneumatic control member 37 is displaced under the additional force of the compression spring 41 in such a way that opening of the sealing element 38 causes the cylindrical space 23 to be put under pressure, so that the pull rod 21 is retracted until it meets the depth stop 6. In that way the location on the component 12, which has been heated by the welding operation, is subjected to a defined pulling force and put back into the appropriate shape, directly in the heated condition.

In the first embodiment according to the invention which therefore does not have the additional pressure relief valve 52 shown in FIG. 2, the feed line 43 leading to the foot portion 26 and the feed line 24 leading to the cylindrical space 23 are so designed that initially only a small amount of cooling air is supplied during the displacement of the piston 18 and the pull rod 21, and a substantially increased amount of cooling air is supplied due to the rise in pressure when the limit position is reached, in which respect attention is directed to FIG. 6. Alternatively, in the second embodiment according to the invention with the pressure relief valve 52 shown in FIG. 2, the pressure relief valve 52 whose position is shown in FIGS. 6 and 7 without however illustrating the actual design configuration thereof totally prevents a feed of cooling air in the conduit 43, before the limit position is reached.

Figure 7:
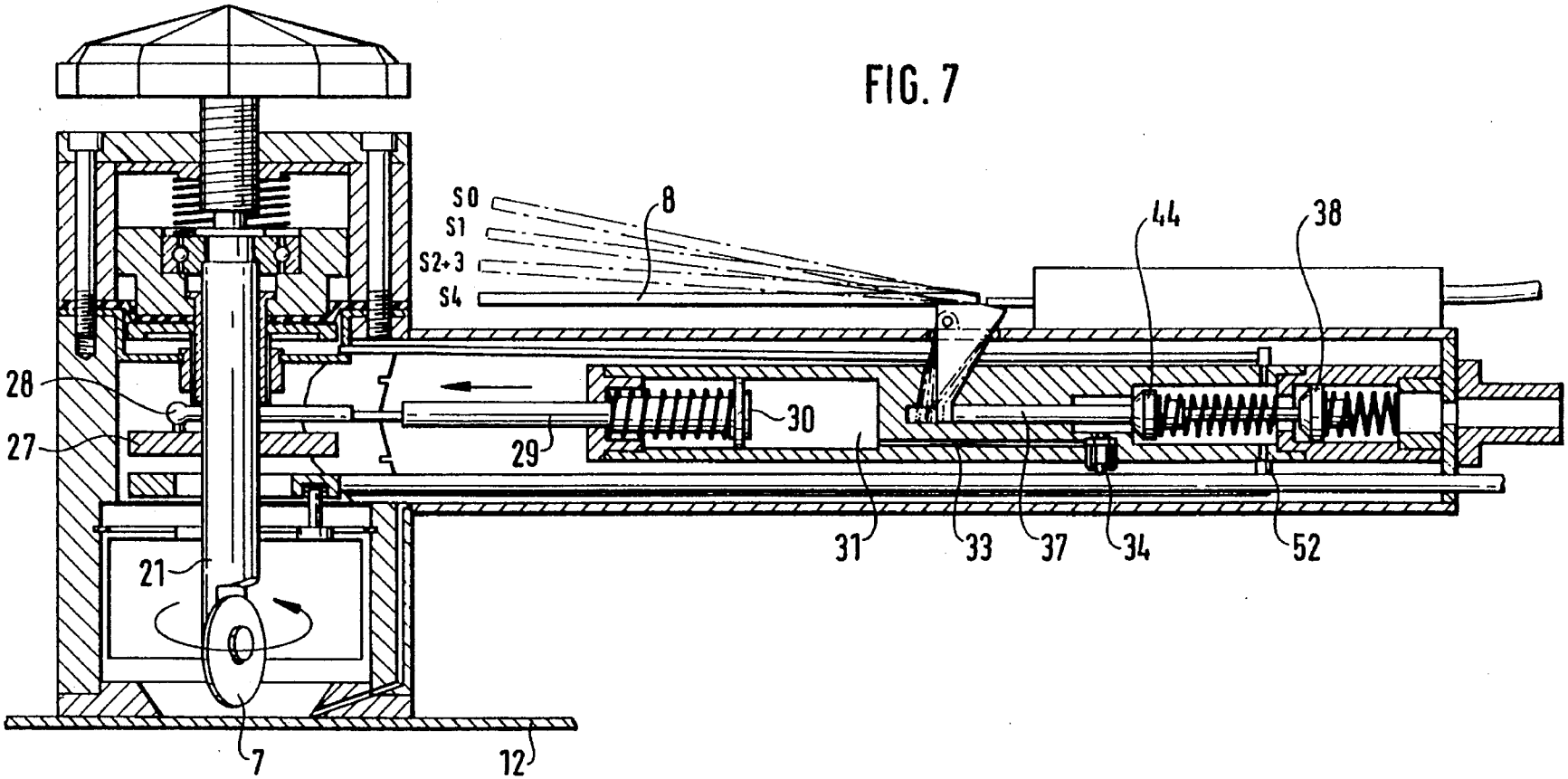
FIG. 7 shows the operation of detaching the holding member from the shaped component by twisting it off.

When the operating element 8 is further depressed into the position S4 as shown in FIG. 7, the connection to the multi-function valve 34 is opened, against the additional force of the compression spring 45 that is perceived by touch, and the above-described rise in pressure occurs and results in the holding member 7 being twisted off the component 12.

The feed lines 24, 33 and 43 can be of such dimensions that even an unskilled operator who immediately after the welding operation pushes the operating element 8 completely into position S4, can obtain an optimum result in terms of restoring the shape of the component 12. For that purpose the respective feed lines 24, 33 and 43 are so designed, or are so fitted with nozzles or throttles, that the slow rise in pressure which occurs firstly results in a gentle retraction movement of the pull rod 21, thereafter the feed of cooling air takes place, and then the holding member 7 is sheared off the component 12. Accordingly, the pneumatic control device 9 provides an automation effect which can provide for execution of the functions of welding the holding member 7 in place, pulling it, cooling, twisting it off and returning the assembly to the initial position, with optimum performance in respect of time.

In a further embodiment according to the invention an electromechanical actuator (not shown) can cause the arrangement to adopt the various positions of the pneumatic control member 37 so that the device 1 is electrically controllable. In that case the feed line 49 can include control lines for the actuators and the supply device 47 can include the appropriate electrical and electronic control groups and units.

When the operating element 8 is released, it moves back into position S0 and the sealing elements 38 and 44 move back into the starting position. The air escapes from the cylindrical space 23 along the line 24 into the chamber 42 from which it is passed through the feed line 43 to the foot portion 26 where it issues. Accordingly the device 1 is then in its starting condition and can be used for further processing operations.

It will be seen therefore that the above-described device is operable to restore damaged motor body parts in a completely different way from the prior-art procedure. The motorized pulling device makes it possible for the first time to use to good effect for restoring damage, the heat which is introduced by the welding operation into the component to be worked, and the higher temperature that the heating effect involves.

It will be noted in this respect that the device disclosed in EP A-0 544 191 as discussed above usually permits even a skilled operator to repair a damaged motor body part at the fastest in between 20 and 30 seconds. In that case however a very considerable cooling effect has already occurred, after the operation of welding the holding member in place on the component, and the repair shaping will generally be of poor quality.

In comparison, the fast motor-actuated repair shaping effect which the device according to the invention can provide makes it possible to achieve repair times in the region of about 1 second and less, and that results in considerably improved and more stable restoration of the heated material to its appropriate shape, before it has completely cooled down. Motor actuation means that manual forces are a secondary consideration, and it is possible for short operating times of the order of magnitude indicated above for the device according to the invention to be maintained over long periods. Even in the case of frequently repeated operating procedures, as for example when repairing severe hail damage, the operator does not suffer from fatigue by virtue of using the device according to the invention, and the speed of operation involved means that it is often possible to avoid a motor vehicle being the subject of a total constructive write-off, where the cost of the repair is considered to be greater than the worth of the vehicle.

The provision of the motor-actuated pulling device means that there is no need for long and therfore bulky lever arms. At most the device must have a handle or gripping portion for handling the device and the overall device can be substantially smaller in terms of its outside dimensions so that it is also possible to operate therewith at inaccessible points. When repairing hail damage, the sheet metal can be exposed for example with abrasive paper, using one hand, while the other hand can be used to apply and operate the device according to the invention. In that situation, the work involved is completely different, extremely fast, fatigue-free and accordingly considerably improved.

It will be appreciated that the above-described embodiments of the device according to the invention have been set forth solely by way of example and illustration of the principles of the invention and that various other modifications and alterations may be made therein without thereby departing from the spirit and scope of the invention.

What is claimed is:

1. A device for deforming a thin-walled component, comprising:

a holding member adapted to be welded to the component, a pulling means for applying a pulling force to said holding member, said pulling means having a motor-actuation means whereby after said holding member has been welded to the component, a part of the component which is to be shaped can be brought into a predetermined limit position by motor actuation of said pulling means, and said motor-actuation means further being operable to disengage said welded holding member from the component.

2. The device as set forth in claim 1, further comprising means for feeding a coolant to a restored portion of the component when the portion is in a heated condition.

3. The device as set forth in claim 2, wherein said coolant is a flow of pressurized air.

4. The device as set forth in claim 1, said motor-actuation means further comprising a single manually actuable operating element for at least one of the operating procedures of welding said holding member to the component, pulling it, cooling, twisting it off and returning it to an initial position.

5. The device as set forth in claim 4, wherein said operating element includes a plurality of actuating positions associated with a set of individual operating procedures.

6. The device as set forth in claim 1 comprising a handle portion and a pneumatic control means which is arranged in the handle portion, said pneumatic control means including a single pneumatic control member, thereby to produce pneumatic control procedures by virtue of the axial positioning of the pneumatic control member.

7. The device as set forth in claim 1, further comprising an adjustable depth stop adapted to set a defined limit position for said pulling means.

8. The device as set forth in claim 1, further comprising an operating means adapted when said pulling means reaches said limit position to produce a feed of cooling air to the component.

9. The device as set forth in claim 8, wherein said operating means further comprises at least one pressure relief valve adapted to open with an increase in pressure in said limit position of said pulling means and producing discharge of cooling air.

10. The device as set forth in claim 1, further comprising an operating means adapted when said pulling means reaches said limit position to produce release of said holding member from the component.

11. The device as set forth in claim 10, wherein said operating means further comprises at least one pressure relief valve adapted to open with an increase in pressure in said limit position of said pulling means and producing release of said holding member from the component.

12. The device as set forth in claim 1, further comprising a jerk-reducing means adapted to provide that the operation of pulling said holding member after it has been welded on to the component is effected in an at least substantially jerk-free manner.

13. The device as set forth in claim 12, further comprising a pneumatic feed line to said pulling means, said jerk-reducing means includes a throttle arranged in said pneumatic feed line.

14. The device as set forth in claim 1, further comprising a pneumatic control group for automating performance of at least one of the operating procedures of pulling said holding member welded to the component, cooling it, twisting it off and returning it to an initial position.

15. The device as set forth in claim 1, further comprising an electrical switch device for providing a supply of electrical current to weld said holding member to the component.

16. The device as set forth in claim 1, said pulling means further comprising at least one foot portion adapted in the pulling operation to support said pulling means against the component, said foot portion having a respectively selectable contact shape.

17. A system for processing thin-wall components including the device as set forth in claim 1 and a supply means for electrical welding of the holding member to the component.

18. A system as set forth in claim 17 wherein said supply means is adapted to provide for an adjustable input of heat with a predeterminable performance in respect of time which results in an adjustable rise in temperature during the operation of welding said holding member to the component.

19. A system as set forth in claim 17 wherein said supply means is adapted to provide for an adjustable input of heat with a predeterminable performance in respect of time, which results in an adjustable rise in temperature after the operation of welding said holding member to the component.

* * * * *

UNITED STATES PATENT AND TRADEMARK OFFICE

CERTIFICATE OF CORRECTION

PATENT NO. : 5,546,786

DATED : August 20, 1996

INVENTOR(S) : Martin Fugel

It is certified that error appears in the above-indentified patent and that said Letters Patent is hereby corrected as shown below:

Column 7, line 41, "to" should be --so --.

Signed and Sealed this

Fourth Day of February, 199

*Attest:*

*Attesting Officer*

BRUCE LEHMAN

*Commissioner of Patents and Trademarks*